US008374770B2

(12) United States Patent
Jung et al.

(10) Patent No.: US 8,374,770 B2
(45) Date of Patent: Feb. 12, 2013

(54) METHOD AND DEVICE FOR ADAPTING AN INJECTION CHARACTERISTIC CURVE

(75) Inventors: Uwe Jung, Wörth a. d. Donau (DE); Janos Radeczky, Wenzenbach (DE); Michael Wirkowski, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 345 days.

(21) Appl. No.: 12/863,730

(22) PCT Filed: Nov. 19, 2008

(86) PCT No.: PCT/EP2008/065813

§ 371 (c)(1),
(2), (4) Date: Jul. 20, 2010

(87) PCT Pub. No.: WO2009/092474

PCT Pub. Date: Jul. 30, 2009

(65) Prior Publication Data

US 2010/0286894 A1 Nov. 11, 2010

(30) Foreign Application Priority Data

Jan. 22, 2008 (DE) ..... 10 2008 009 071

(51) Int. Cl.
*F02M 51/00* (2006.01)
*F02D 41/34* (2006.01)

(52) U.S. Cl. ..... 701/104; 701/106; 701/114; 123/436; 123/406.14; 123/324; 123/325

(58) Field of Classification Search ..... 701/104, 701/106, 114; 123/324, 325, 406.14, 436; 73/114.48

See application file for complete search history.

(56) References Cited

U.S. PATENT DOCUMENTS 6,085,142 A * 7/2000 Di Leo et al. ..... 701/104
7,025,047 B2 * 4/2006 Leman et al. ..... 123/486

(Continued)

FOREIGN PATENT DOCUMENTS

CN 1884811 A 12/2006
DE 3724420 A1 2/1989

(Continued)

OTHER PUBLICATIONS

German Office Action, German Patent Application No. 10 2008 009 071.9-26, 3 pages, Sep. 23, 2008.

(Continued)

*Primary Examiner* — Erick Solis
(74) *Attorney, Agent, or Firm* — King & Spalding L.L.P.

(57) ABSTRACT

When the internal combustion engine is in an injection-free operating mode, a selected injector is open for injecting a small fuel amount, whereby at least one working cycle with injector control follows or precedes one cycle without control, a differential of two subsequent segment times of the cylinder associated with the selected injector or another variable, that reproduces a temporal crankshaft angle speed modification, is determined as a measurement value respectively for the cycle with and without control, and a relation is formed between the values of the cycles with or without control and used to correct the injection characteristic curve. The engine operates with active ignition and the value for the cycle with control is tested by taking into account ignition faults and the relation is only used to correct the curve if the value in the cycle with control significantly deviates from the one without control.

20 Claims, 4 Drawing Sheets

U.S. PATENT DOCUMENTS

| | | | | |
|---|---|---|---|---|
| 7,139,657 | B2 | 11/2006 | Bouchain et al. | 701/104 |
| 7,209,824 | B2 * | 4/2007 | Henn et al. | 701/103 |
| 7,269,500 | B2 | 9/2007 | Cochet et al. | 701/114 |
| 7,293,453 | B2 | 11/2007 | Aono et al. | 73/117.3 |
| 7,628,146 | B2 * | 12/2009 | Kloppenburg et al. | 123/673 |
| 7,930,090 | B2 * | 4/2011 | Weiss et al. | 701/105 |
| 7,945,372 | B2 * | 5/2011 | Geveci et al. | 701/103 |
| 7,957,919 | B2 * | 6/2011 | Marconi | 702/45 |
| 8,108,130 | B2 * | 1/2012 | Scheuerer | 701/109 |
| 2006/0047405 | A1 | 3/2006 | Bouchain et al. | 701/104 |
| 2007/0251507 | A1 | 11/2007 | Mueller et al. | 123/493 |

FOREIGN PATENT DOCUMENTS

| | | |
|---|---|---|
| DE | 10257686 | 7/2004 |
| DE | 102006021301 | 11/2007 |
| EP | 1705355 | 9/2006 |
| EP | 1736655 | 12/2006 |
| EP | 1843023 | 10/2007 |

OTHER PUBLICATIONS

International PCT Preliminary Report on Patentability, PCT/EP2008/065813, 9 pages, Nov. 19, 2008.

International Search Report and Written Opinion for Application No. PCT/EP2008/065813 (17 pages), Jun. 3, 2009.

Chinese Office Action, Chinese Patent Application No. 200880125415.4, 25 pages, Aug. 3, 2012.

* cited by examiner

METHOD AND DEVICE FOR ADAPTING AN INJECTION CHARACTERISTIC CURVE

CROSS-REFERENCE TO RELATED APPLICATIONS

This application is a U.S. National Stage Application of International Application No. PCT/EP2008/065813 filed Nov. 19, 2008, which designates the United States of America, and claims priority to German Application No. 10 2008 009 071.9 filed Jan. 22, 2008, the contents of which are hereby incorporated by reference in their entirety.

TECHNICAL FIELD

The present invention relates to a method for adapting an injection characteristic curve, and to a device for carrying out a method of this type.

BACKGROUND

Many internal combustion engines comprise an injection device having injectors that inject fuel into the combustion chambers. The injectors or injection valves are controlled by a suitable control device in order to optimally proportion the fuel amounts. The fuel amounts are generally proportioned in a time-controlled manner, i.e. the injector is opened for a precisely determined period of time and is then closed again. This period of time is referred to in this instance as the control period of the injector.

A characteristic map is normally present in a control device of the internal combustion engine and this determines a desired injection characteristic curve, i.e. a correlation between injected fuel amounts and the control period. It is important to be able to adjust the injected fuel amounts accurately, so the internal combustion engine can function at its optimal working point.

An actual injection characteristic curve may deviate from the desired injection characteristic curve owing to production-related variations or age-related changes of the injectors or internal combustion engine. This means that the correlation between the control period and the injected fuel amount in the actual state may deviate from the desired state. Since the changes are normally very slight changes to the injection amounts, the absolute value of which is largely independent of the control period or injection amount, a minimum amount is often adapted in order to adapt the injection characteristic curve.

Adaptation of a minimum amount of this type is disclosed in greater detail in document DE 102 57 686 A1. In this case an injection valve characteristic curve of a controlled injector of an internal combustion engine reproducing a single-reference injection behavior is adapted to age-related changes of an actual injection behavior in that the injection valve is controlled intermittently in accordance with a control period during an operating mode of the internal combustion engine that does not require fuel injection, whilst otherwise no fuel is injected so at least one working cycle of the internal combustion engine with control follows or precedes at least one working cycle without injection valve control and in each case a speed value or a value of a speed-dependent variable of the internal combustion engine is detected for the working cycle with control and for at least one of the working cycles without control and a differential between the detected values is formed and therefore the injection characteristic curve is corrected.

The method from the aforementioned document thus yields satisfactory results if the internal combustion engine is a diesel engine. A drawback of this method is therefore linked to the fact that, in order to take into account the value measured during the working cycle with control, it is merely assumed that an injection has taken place. Since with petrol engines or internal combustion engines with active ignition an injected minimum amount of fuel does not necessarily have to be ignited, the method disclosed in the referenced document is not suitable for internal combustion engines with active ignition.

SUMMARY

According to various embodiments, a suitable method for adapting an injection characteristic curve that is suitable for application with a petrol engine can be provided. According to further embodiments, a device with which a method of this type can be carried out can be developed.

According to an embodiment, a method for adapting an injection characteristic curve of an internal combustion engine, comprising at least one cylinder, to age-related changes or production-related variations of an actual injection behavior, where at least one injector for injecting fuel is associated with each cylinder, may comprise: a) when the internal combustion engine is in the operating mode that does not require an injection of fuel, a selected injector is open over a control period for injecting a minimum amount, at least one working cycle with injector control following or preceding at least one working cycle without injector control, b) in each case a differential of two subsequent segment times of the internal combustion engine or another variable, which reproduces a temporal modification of a crankshaft angular velocity, is determined as a measurement value for the working cycle with control and for the working cycle without control, and c) a relation is formed between the measurement values of the working cycles with and without control and is used to correct the injection characteristic curve, wherein the internal combustion engine operates with active ignition, the measurement value for the at least one working cycle with control being examined in order to take into account ignition faults and the aforementioned relation then only being used to correct the injection characteristic curve if the respective measurement value in the working cycle with injector control significantly deviates from the measurement value or the measurement values in the working cycle or in the working cycles without injector control.

According to a further embodiment, the aforementioned measurement values can be measured over a plurality of working cycles. According to a further embodiment, the injection characteristic curve can be adapted successively for at least two, preferably all injectors of the internal combustion engine. According to a further embodiment, the injection characteristic curve can be adapted in each coasting phase or after a specific running time interval or a specific running distance interval during a coasting phase. According to a further embodiment, the aforementioned method steps can be carried out for at least two different, preferably a large number of control periods. According to a further embodiment, the aforementioned method steps can be carried out for at least two different, preferably a large number of control moments. According to a further embodiment, a characteristic map for controlling an injector can be adapted during the correction process, the characteristic map setting the control period in relation to the injection amount or one of the variables determining the injection amount, preferably as a function of temperature and/or fuel pressure and/or other parameters. According to a further embodiment, in order to determine the significance of the deviation of the measurement value with injector control from the measurement value without control, the measurement values of a plurality of working cycles can be recorded and a mean value for the measurement value in the working cycle without control can then be formed, the significance being defined as a function of the standard deviation of the measurement values without control or of a threshold for the deviation from the aforementioned mean value. According to a further embodiment, a setting can be determined by additionally varying at least one parameter of injection of the minimum amount, in which the number of ignition failures is minimized. According to a further embodiment, the control period of the injector or injectors can be adapted in such a way that a desired value of the deviation of the measurement values with injector control from the measurement value without control is obtained for injection of the minimum amount and this change is taken into account during operation of the internal combustion engine, even for larger injection amounts.

According to another embodiment, a device for adapting an injection characteristic curve, can be set up by programming to carry out a method as described above.

According to a further embodiment of the device, it comprises an engine control system of the internal combustion engine. According to a further embodiment of the device, the device may comprise at least one sensor for acquiring a segment time of a crankshaft movement of the internal combustion engine and/or a current crankshaft angular velocity.

BRIEF DESCRIPTION OF THE DRAWINGS

Exemplary embodiments will be described hereinafter in greater detail with reference to the drawings, in which.

DETAILED DESCRIPTION

Figure 1A:
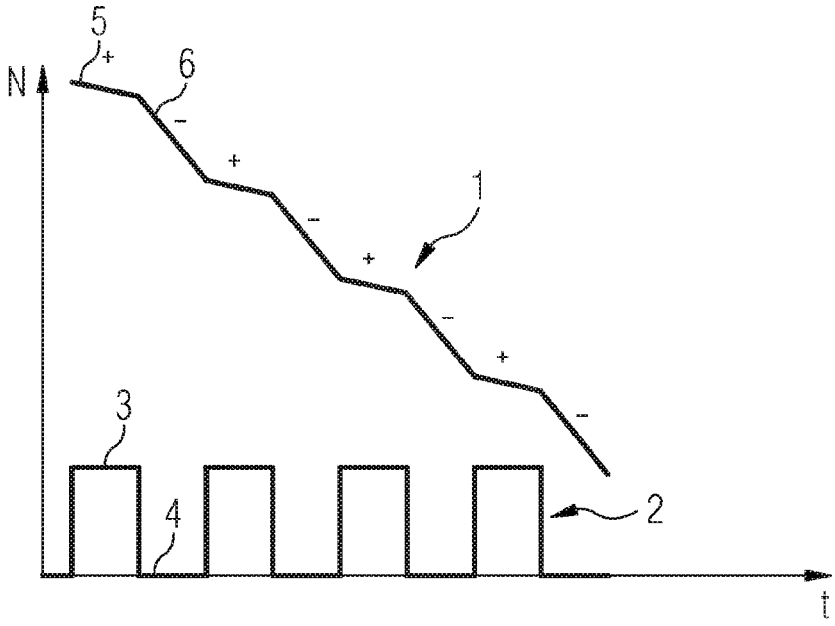
FIG 1A Prior Art
FIG. 1A is an illustration of the method for adapting the injection characteristic curve in accordance with the prior art in diesel engines.

With the method according to various embodiments, a differential of two subsequent segment times of the cylinder associated with the selected injector or another variable, which reproduces a temporal modification of a crankshaft angular velocity, is determined as a measurement value for the at least one working cycle with injector control and for the at least one working cycle without injector control. In this instance a segment time refers to the time it takes for a crankshaft of the internal combustion engine to pass through a specific angular segment. In this case an angular segment may be defined, for example, as 720° divided by the number of cylinders of the internal combustion engine. The angular segments should be ascertained in such a way that if the corresponding injector is controlled then a fuel amount injected into the cylinder by an injector is ignited either when or just before one of the two angular segments is passed through and the change in the segment time can thus be measured.

A relation is formed between the measurement values of the working cycles with and without control and is used to correct the characteristic injection curve, it being examined in each case, in order to take into account ignition faults of the at least one measurement value for the working cycle with control, whether this measurement value significantly deviates from the measurement value or measurement values of the injector in the working cycle or in the working cycles without control. The aforementioned and determined relation is used to correct the injection characteristic curve only if this is indeed the case. The aforementioned relation may, for example, be a differential between the measurement value with injector control and the measurement value without control, or a mean value, detected over a plurality of working cycles, for the measurement value without control, or a similar value that mirrors the actual injection amount in the working cycle with injector control.

The advantage of the method according to various embodiments is that measurement values are discarded in which there is, in fact, injection but no ignition of the injected fuel mixture. Any falsification of the correction made owing to an erroneous estimation of the actual injection characteristic curve caused by ignition faults is thus prevented. Since, in the case of injection without ignition, the differential of subsequent segment times or the other variable, which reproduces a temporal modification of the crankshaft angular velocity, only differs slightly from the corresponding measurement value for the working cycle without injection, a reliable decision can be made as to whether the fuel was ignited when acquiring a measurement value with control, provided the differential of two subsequent segment times or of the measurement value for the aforementioned other variable for the working cycle without control is known.

A further advantage of the method is that it is largely independent of external operating conditions of the internal combustion engine. The segment time or the speed or rotational speed of the internal combustion engine does not constitute a constant variable, but is merely a snapshot of a variable that is generally changeable over time. Any braking or acceleration of the internal combustion engine caused by friction or an incline has no effect on the method resulting in falsification of the result since, in each case, the differential of two variables of the above type or the angular acceleration of a crankshaft movement is determined and the measurement values with and without injection thus obtained are compared. The injection characteristic curve can thus be adapted reliably and accurately to the required desired values for the injection amount.

During the measurement the supplied fuel amount may be calculated by comparing the torque values that are active in the working cycle with control and in the working cycle without control. In this instance the torque is the product of moment of inertia and angular acceleration, the angular acceleration being formed, for example, over a speed gradient or a segment time differential during a working cycle with control and over a speed gradient or a segment time differential during a working cycle without control. The moment of inertia of the internal combustion engine is thus influenced by the centrifugal mass of pistons, crankshafts, camshafts and possible centrifugal masses and is a fixed, constant variable for an internal combustion engine. In this instance a factor for the inner friction of the internal combustion engine may also be added, as is disclosed for example in document DE 102 57 686 A1. A number of options for determining a torque value from segment times or speed gradients are also disclosed in this document.

The method can be particularly preferably carried out over a plurality of working cycles of the internal combustion engine. If a plurality of cycles, for example 10 to 100, preferably 10 to 20 cycles are used, the measurement values can be evaluated reliably and statistically. In particular, this is therefore important so a reasonable threshold or a reasonable statistical measure can be determined as a function of the measurement values that are determined in the working cycles without control, in order to detect measurement values in working cycles with injector control, i.e. with fuel injection where there is no ignition.

The described steps of the method for adapting the injection characteristic curve can be preferably carried out successively for at least two, preferably for all injectors of the internal combustion engine. It is therefore advantageous if, during a working cycle of the internal combustion engine, an injection valve is controlled in each case in order to study the injection characteristic curve of this injector in a particularly accurate manner. After a plurality of working cycles in which this selected injector was controlled, a further injector or all injectors of the internal combustion engine may be controlled accordingly and successively. It is therefore possible to adapt the injection characteristic curve not only for an individual injector, but for the entire internal combustion engine.

The method for adapting the injection characteristic curve can be preferably implemented using a control process, which can be preferably carried out automatically in each coasting phase, i.e. during an operating mode of the internal combustion engine in which no fuel injection is required, or during or following a specific internal combustion engine running time interval, or following a specific internal combustion engine running distance interval during a coasting phase. The injection characteristic curve should be adapted regularly, but not necessarily continuously. Intervals can be established by an automatic control system, for example in this instance a running distance interval of approximately 10,000 km or a running time interval of approximately 50 engine hours being provided. Of course these variables can be adapted in accordance with general experience of internal combustion engines and everyday requirements.

In an embodiment of the method the aforementioned method steps are carried out for at least two different, preferably a large number of control periods. Since the method steps are preformed over a large number of control periods, the entire injection characteristic curve of the injector can be adapted more accurately because it is possible to determine whether a drift of the actual injection amount is dependent on the control period. In an embodiment the control periods are, in this instance, increased incrementally, the increment depending on the desired accuracy of the correction of the injection characteristic curve. Two increments are generally sufficient, with which a minimal and a somewhat greater control period or injection amount are examined.

The method can be particularly preferably carried out in such a way that a characteristic map for controlling an injector is adapted during the correction, the characteristic map setting the control period, preferably as a function of temperature and/or fuel pressure and/or other parameters, in relation to the injection amount or to one of the variables determining the injection amount, for example to a desired torque. During running operation the fuel amount supplied within a specific control period changes in such a way that the relation between these must be re-established. The values obtained within the method can be used for engine control and to adapt the injection characteristic curve by supplying the relation in a characteristic map. It is therefore particularly advantageous if the temperature and/or fuel pressure, which influence the injection amount, are also recorded outside the control period in order to control the injectors more accurately. The described adaptation of a minimum amount is thus particularly advantageous if, during the normal operating mode, the valves or injectors fill the combustion chambers of the internal combustion engine for each working stroke with a plurality of at least partially small injections. With an accurately adapted characteristic map of the type described above it is possible, for example, to observe strict exhaust emission standards since the tolerances of the injectors can be kept very low. It is also possible to achieve particularly economical operation by controlling the injectors accurately, possibly in the long-term, by way of the various embodiments.

With regard to the decision as to whether a measurement value obtained in a working cycle with control deviates significantly from a measurement value from a working cycle without control, both the measurement values of working cycles with control and the measurement values of working cycles without control can be measured and all measurement values evaluated. It is therefore advantageous if a working cycle with injector control and a working cycle without control alternate.

Alternatively, a plurality of working cycles without control could also first be carried out, the measurement values of the working cycles without control being evaluated statistically with reference to the values thus obtained. Measurement variables, which for example were determined from a differential of measurement values from a working cycle with control and a working cycle without control, may then be compared individually with the statistical evaluation of the measurement values of the working cycles without control in order to individually determine, for each measurement value acquired with injection of a minimum amount, whether ignition occurred or not.

It is possible to determine a statistical distribution from the measurement values that are measured in working cycles without control. This distribution can be approximated by a normal or uniform distribution, in particular the mean value and the variance of the distribution being determined. The standard deviation can then be determined from the variance. A variable that is dependent on the standard deviation, for example a multiple of the standard deviation, may constitute a criterion for whether ignition took place or not for a measurement value in the working cycle with control. However, it is also possible to form, as a basis for assessment, a minimum absolute deviation from the mean value of the measurement values without injection, this absolute deviation being supplied with reference to the mean value and the variance in order to take into consideration a measurement value with injection. The decision as to whether a measurement value obtained in a working cycle with control is a measurement value that should be taken into account and used in the evaluation to adapt the injection characteristic curve is therefore positive if a measurement value from a working cycle with control deviates significantly from the distribution of the measurement values in the working cycle without control. The information given for measurement values naturally also applies to measurement variables that are generated from a plurality of measurement values.

The method according to various embodiments may also be modified in such a way that by varying at least one parameter, for example the control moment of the injector, a setting can be determined in which the number of ignition faults is minimized. This makes it possible to easily carry out a statistical evaluation with reference to the occurrences with and without ignition. The internal combustion engine can therefore be operated in a smoother and more economical manner.

A method may be particularly preferred in which, following measurement of the values in the working cycle with and without control, the control period of an injector can be adapted in such a way that a desired value for the injection of the minimum amount or a desired value for a fuel amount is obtained and this change is taken into account during operation of the internal combustion engine, even under load. The correction determined for the minimum amount may thus be applied, in an advantageously simple manner, as an offset correction to all (generally larger) injections.

The method for adapting an injection characteristic curve may be preferably carried out using a device that is configured technically in such a way that the method can be carried out and implemented as a program. The device can be particularly preferably connected to an engine control system of the internal combustion engine. The method may therefore be implemented as software or as a hardware circuit in the control unit. The software may preferably be uploaded in an existing engine control system by an update and take effect there. In a further embodiment, the device comprises a sensor for detecting segment times of a crankshaft movement of the internal combustion engine and/or a current crankshaft angular velocity. The variables to be measured are thus acquired and then evaluated in the device.

A fuel mass K is introduced into a combustion chamber, i.e. into a cylinder of an internal combustion engine, using an injector. In this instance the injector is controlled by a corresponding control unit in order to supply the fuel mass K, i.e. the injector receives an instruction to open for the control period. Owing to mechanical and electrical conditions, the injector only supplies a fuel amount from a specific value of the control period. This value thus corresponds to the shortest control period in which fuel can be supplied. Reference should again be made to document DE 102 57 686 A1, in particular to FIG. 1, for the exact embodiments regarding the minimum control period.

Referring to FIG. 1A a speed curve 1 of an internal combustion engine during a coasting phase is illustrated. An individual injector of the internal combustion engine, which is selected in advance, is instructed by a control signal 2 to control the injector in every second working cycle so it injects a minimum amount, i.e. to carry out this working cycle as a working cycle with injection 3. Two working cycles with injection 3 are thus separated in each case by a working cycle without control of the corresponding injector, i.e. as a working cycle without injection 4. The plotted width of the control signal 2 in the working cycles with injection 3 does not therefore correspond to the time for which the injector is open, but to the period of an entire working cycle. The actual control impulse is a lot shorter and is given at a moment generally shortly before a top dead centre before a working stroke of the corresponding cylinder.

The speed curve 1 shows decreasing speed. In this instance the speed curve 1 does not extend uniformly, but in a slightly stepped manner in accordance with the control signal 2 owing to the injections of fuel. The internal combustion engine is thus in the disengaged state, no further load whatsoever being coupled to the engine outside the minimum fuel injection. It can be seen clearly that the speed curve extends in a more planar manner with injection of the minimum amount 5, i.e. the speed decreases less quickly if the injector is controlled compared to a speed curve without injection of the minimum amount 6, in which no fuel is supplied to the cylinder. With a working cycle with injection 3, there is torque owing to an ignition of the injected fuel amount and this acts on the internal combustion engine and becomes noticeable (compared to the speed curve 6 without control) as a result of the speed curve 5 that is falling less sharply.

The speed curve 1 may be determined over segment times. The segment time basically reproduces the current velocity of the crankshaft. This corresponds to a specific speed value, which is generally based on minutes. The differential of two speed values or two segment times, normalized to the time period of a working cycle, may reproduce the gradient of the speed curve or a temporal change in a crankshaft angular velocity. A teaching is thus easily obtained as to how the speed curve 1 of FIG. 1A can be found from the segment times. A "perfect" internal combustion engine is basically shown in FIG. 1A since it shows a torque as a result of ignition with each control with injection, this torque being reflected in the speed curves 5 denoted by "+" and in the speed curves 6 denoted by "−". This curve is realistic in a diesel engine since, in this instance, the fuel amount is ignited spontaneously owing to physical conditions.

Figure 1B:
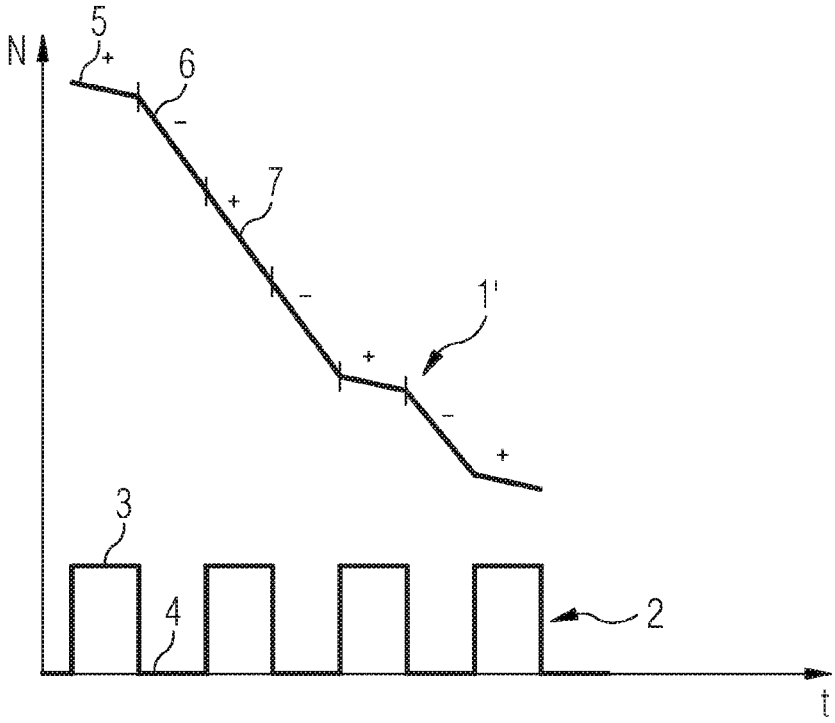
FIG. 1B is an illustration of the method for adapting the injection characteristic curve with an internal combustion engine with active ignition.

Referring to FIG. 1B a comparable speed curve 1' of a petrol engine is shown that, inter alia, comprises a region in which the speed curve 1', despite injector control, does not differ substantially from the adjacent speed curves without injection of a minimum amount 6. This is the case if the fuel mixture is not ignited despite fuel injection, for example because there is not enough fuel or ignitable mixture in the direct environment of a spark plug of the corresponding cylinder, and therefore no torque acts on the crankshaft. A speed curve with ignition failures 7 is thus produced in the aforementioned region and does not differ substantially from the speed curves without injection of a minimum amount 6, but deviates strongly from the speed curves with injection of a minimum amount 5 where the injected fuel amount is ignited and torque is therefore produced.

The speed curve 1' shown in FIG. 1B is determined by acquiring the corresponding segment times using a sensor that senses a crankshaft movement. In particular, differentials between two subsequent segment times in each case are, in this instance, acquired as measurement values that reproduce a change in speed or a change in crankshaft angular velocity. When evaluating these measurement values in order to adapt or correct an injection characteristic curve of the petrol engine to age-related changes or production-related variations of a current injection behavior, a measurement value that corresponds to the portion of the speed curve 1' reproducing the speed curve with ignition failures 7 is detected and discarded since this speed curve with ignition failures 7 clearly does not significantly differ from the speed curves without injection 6. This is described again in greater detail with reference to FIG. 2B.

Figure 2A:
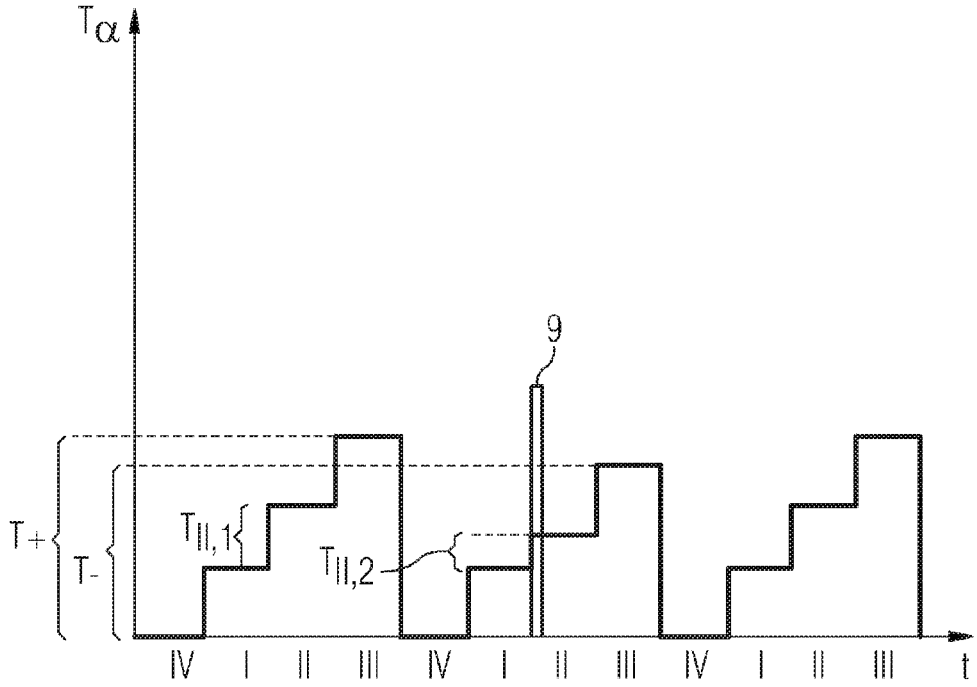
FIG. 2A is a diagram explaining segment time.

Referring to FIG. 2A a time curve of a segment time signal 8 is shown in a diagram. In this case the running time t is plotted on the abscissa whilst the segment time $T_{\alpha}$, i.e. the time it takes for the crankshaft to pass through a specific angular segment, is plotted on the ordinate. The illustration of FIG. 2A is based on a four-cylinder engine (not visible in the diagram) that is operated by a four-stroke cycle. In this case a working cycle is divided into four angular segments, each measuring 180° and each associated with a working stroke of a cylinder denoted by I to IV, the measured segment times in the illustration of FIG. 2A each being added up until one working cycle has been completed. However, any shorter or relatively staggered intervals may also be selected. In the curve of the segment time signal 8 shown here, an injector of the second cylinder II is controlled. For example, the segment time $T_{II,1}$ is recorded in a first interval, which is associated with the cylinder II and occurs in a working cycle without injection 4. The circulation time T+ for passing through the working cycle without injection 4 is plotted on the ordinate.

In a subsequent working cycle the injector of the cylinder II is controlled by a control impulse 9. In this case torque is transferred to the crankshaft owing to the injection of a minimum amount and the ignition thereof, this crankshaft passing through the angular segment associated with the cylinder II in a quicker time $T_{II,2}$. The corresponding circulation time T−, i.e. a total duration of the working cycle with injection 3, is also shorter than the total duration T+ of the working cycle without injection 4.

A current speed, i.e. an angular velocity of the crankshaft can be ascertained from the segment times $T_\alpha$ and the circulation times T− and T+ of a working cycle with injection 3 or of a working cycle without injection 4. The values thereof are, for example and as shown in FIGS. 1A and 1B, converted into a speed curve 1, 1'. However, it is also possible for a similar result to be achieved over the circulation time T+ or T− since the circulation time is substantially inversely proportional to the speed.

Figure 2B:
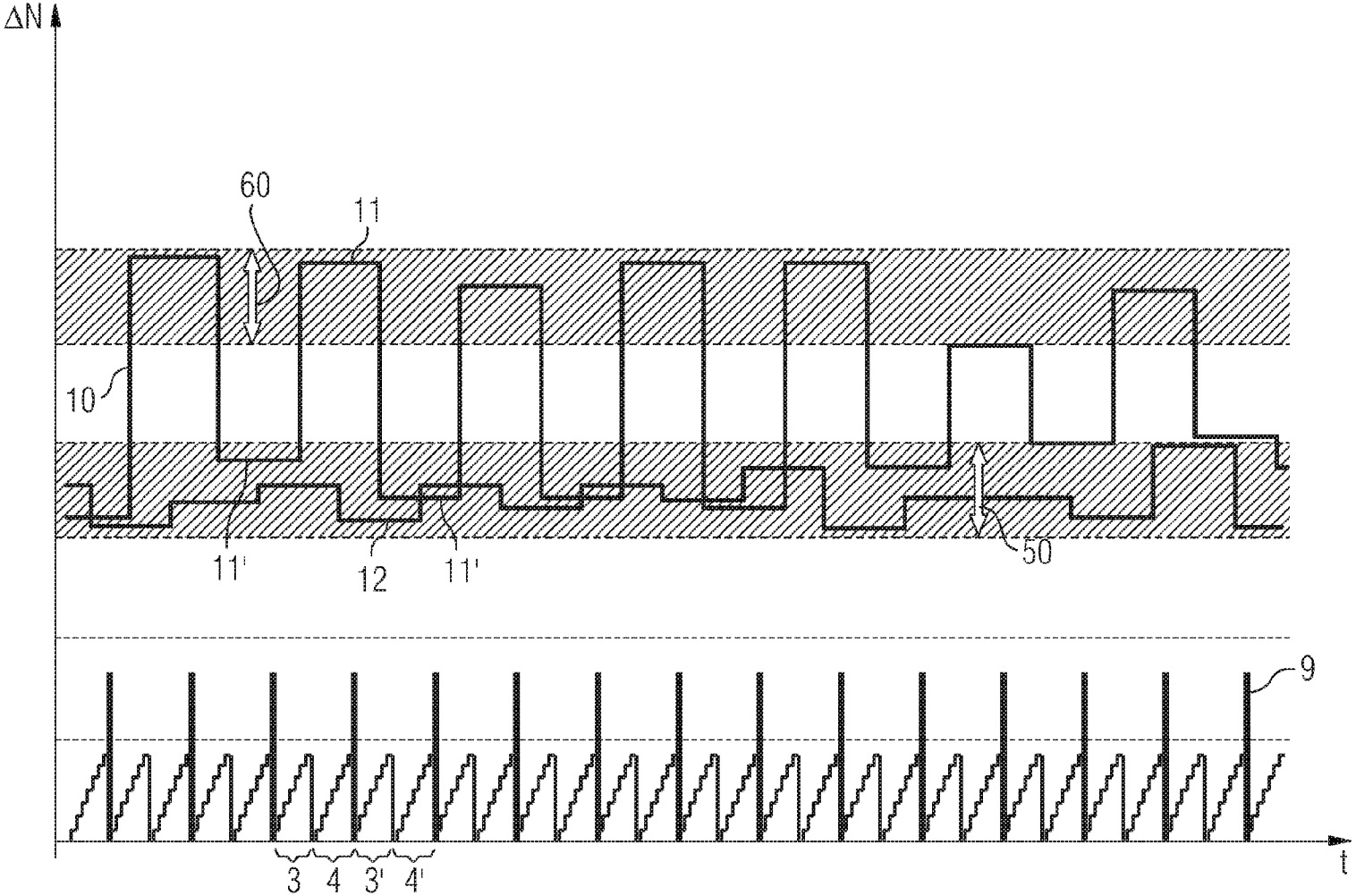
FIG. 2B is a diagram with reference to the speed gradient.

Referring to FIG. 2B the relationship between running time t and a speed gradient ΔN is shown. Different portions associated with the alternating working cycles with injection 3, 3' and working cycles without injection 4, 4' are on the time axis, as already described with reference to FIG. 2A. In this instance FIG. 2B is based on an eight-cylinder petrol engine, in which a minimum amount is injected in a coasting phase into a selected cylinder by the corresponding injector during every second working cycle, this causing no noticeable propulsion, but instead only adapting the minimum amount in the manner described. Control impulses 9 are accordingly illustrated in FIG. 2B and, in this case, are symbolic of the fact that the selected injector is controlled during every second working cycle. A step function is illustrated between the control impulses and shows eight different values, in each case for one of eight angular segments (in this case each established as measuring 90°, for each working cycle. The speed gradient ΔN corresponds to angular acceleration. A similar curve would be produced for the above-mentioned measurement variable defined as the differential of two subsequent segment times from each working cycle, this measurement variable being a measure for the crankshaft angular velocity.

On the one hand, the angular acceleration measured once for each working cycle with injection 3, 3' is illustrated in FIG. 2B with injection of a minimum amount 10. The curve of this speed acceleration 10 is extremely gradual. Basically, two groups of values for these measurement variables can be established: on the one hand angular accelerations with ignited injection of a minimum amount 11 and, on the other hand, angular acceleration with unignited injection of a minimum amount 11'.

Furthermore, the angular acceleration measured once for each working cycle without injection 4, 4' is shown without injection of a minimum amount 12. It can be seen clearly that the angular accelerations with unignited injection of a minimum amount 11' lie in a value range that substantially corresponds to the angular acceleration without injection of a minimum amount 12. A scattering interval of the measurement values without injection of a minimum amount 50 can be established for the angular acceleration following a large number of individual measurements. This is shown in FIG. 2B as a shaded region. In this instance a deviation from the mean value by a multiple of the standard deviation, or an absolute deviation from the mean value, or an absolute deviation from the maximum value of the measurement values of the angular acceleration without injection of a minimum amount 12 can be used as a criterion for the size of the scattering interval of the measurement values without injection of a minimum amount 50.

It can be seen easily that the measurement values for the angular acceleration with unignited injection 11', measured in working cycles in which a minimum amount is indeed injected but this minimum amount is not ignited, are all arranged substantially within the scattering interval of the measurement values without injection of a minimum amount 50. These measurement values therefore do not deviate substantially significantly from the measurement values without control or from the variables formed therefrom. Once the measurement values for angular acceleration with unignited injection of a minimum amount 11' have been recognized as failed ignitions, a scattering interval, namely a scattering interval of the measurement values with ignited injection of a minimum amount 60, can be formed with the remaining measurement values for angular acceleration with ignited ignition of a minimum amount 11. This is illustrated in FIG. 2B, also as a shaded region.

Figure 3:
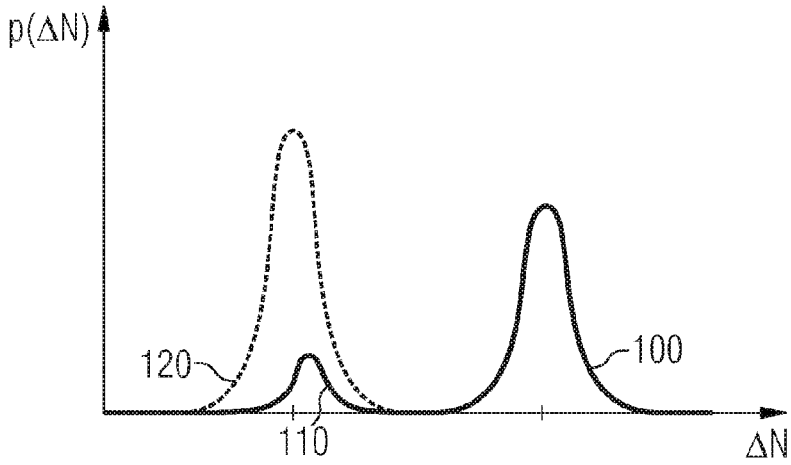
FIG. 3 shows a distribution of the speed gradient with and without control.

This will be explained again in greater detail in FIG. 3. Referring to FIG. 3 the value of the speed gradient ΔN is plotted on the abscissa, whilst the number of occurrences or the distribution p of the speed gradient is plotted on the ordinate. The measurement values for angular acceleration with injection of a minimum amount 10 are illustrated in a bar chart or a distribution with two regions, namely a region 100 reproducing angular acceleration with ignited injection of a minimum amount 11 and a region 110 reproducing angular acceleration with unignited injection of a minimum amount 11'. A bar chart or distribution 120 of angular acceleration without injection of a minimum amount 12 is also shown. In this instance all distributions were approximated to a Gaussian distribution, the measurement values for angular acceleration with ignited and unignited injection of a minimum amount 11 and 11' being handled separately.

It can be seen clearly that the first-mentioned distribution in the region 110 lies within the distribution 120. It can also be seen that the region 100 of the first-mentioned distribution is distant from the bar chart 120 and from the bar chart 110 from a statistical point of view. Also, a slight overlap between the region 100 and the distribution 120 could, for the most part, still be treated and analyzed statistically. If the distribution 120 has been determined once, it can be predicted relatively safely whether a measurement value of the curve of angular acceleration with injection of a minimum amount 10 is associated with the measurement values for angular acceleration with ignited injection of a minimum amount 11 or with the measurement values for angular acceleration with unignited injection of a minimum amount 11'. It is thus clear that the method explained in this instance for detecting failed ignitions and faults in the measurement values taken during the failed ignitions complements the previous method for adapting an injection characteristic curve and, in particular, makes it accessible for petrol engines.

In the cases of the figures shown in this instance an injector was controlled in each case so as to make it possible to adapt the injection characteristic curve. Of course two or preferably all injectors of the internal combustion engine may also be controlled successively in such a way that the injection characteristic curve is adapted for all injectors.

The measurement values shown in this case and the values determined therefrom can be preferably evaluated using a control system. It may also be sensible for the method to be carried out for at least two different, preferably a large number of control periods, since the injection characteristic curve can therefore be adapted in an optimal manner. In addition the pairs of variates of the control period often stored within a characteristic map are continuously corrected to the fuel amount in such a way that the new control periods are associated with the fuel amounts by adapting the injection characteristic curve. Of course the method may also be varied in such a way that the injection process is carried out at different control moments or at different fuel pressures, which is beneficial in particular if the injection process of an injector is carried out in a plurality of steps, i.e. the entire fuel amount is injected by opening the injector a number of times.

Figure 4:
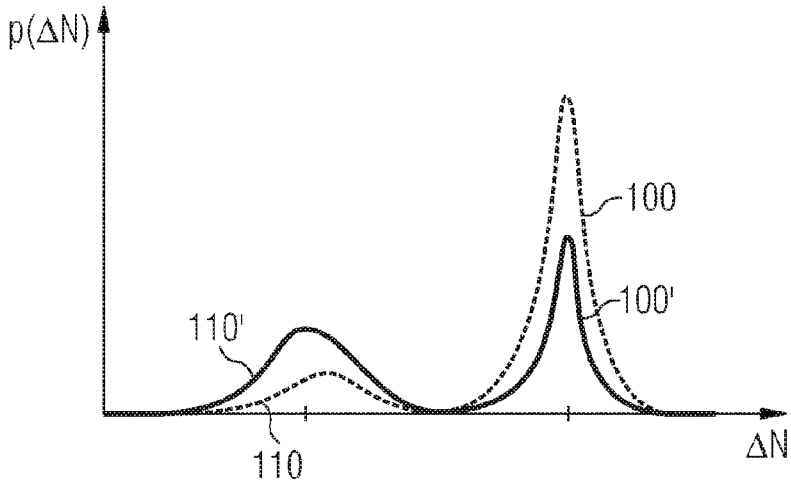
FIG. 4 shows different distributions of the speed gradient for different numbers of ignition failures.

A further beneficial variant of the method is described with reference to FIG. 4. Referring to FIG. 4 two distributions can be seen: a first distribution from the regions 100 and 110 and a second distribution from the regions 100' and 110'. The regions 100, 100' of the bar chart indicate speed gradients that have been illustrated with injector control to inject a minimum amount with ignition. Similarly, the regions 110, 110' constitute those parts of the respective distribution in which the mixture was not ignited, despite injection. The different distributions were ascertained as a result of a variation in either control period, control moment or other parameters known to the person skilled in the art that may affect the injection characteristic curve. An injection characteristic curve can thus be found that has particularly few ignition failures, as shown in the distribution by regions 100 and 110. An injection characteristic curve of this type may, in turn, be stored or filed in a characteristic map.

In the method described with reference to FIGS. 1 to 4, following evaluation of the injection characteristic curve of an injector in the working cycle with and without injector control, the control period of the selected injector is adapted in such a way that a desired value of the deviation of the measurement values for the working cycles with injector control and ignition from the measurement values or a mean value of the measurement values without ignition for injection of the minimum amount is obtained, a change or correction carried out for this being considered as an offset correction during operation of the internal combustion engine, even for larger injections. This means that, even during normal operation of the internal combustion engine, i.e. with acceleration and under steady load the control period-minimum amount pairs, determined by adapting the minimum amount, are formed so as to ascertain corrected control periods, even for larger injection amounts, and therefore make it possible to achieve economical and smooth operation of the internal combustion engine.

The adaptation of the minimum amount, in which the injection characteristic curve is adapted in the manner described by correcting control times for desired injection amounts, for example in order to compensate for a drift in the injection behavior of the corresponding injector, is carried out in such a way that out of all the measurement values for angular acceleration with injection of a minimum amount 10, only those are used that reproduce angular accelerations with ignited injection of a minimum amount. The measurement values are therefore examined using the described statistical criteria in order to ascertain whether they deviate significantly from the measurement values in the working cycles without injection and are rejected when this is not the case.

What is claimed is:

1. A method for adapting an injection characteristic curve of an internal combustion engine, with at least one cylinder, to age-related changes or production-related variations of an actual injection behavior, where at least one injector for injecting fuel is associated with each cylinder, the method comprising:

a) when the internal combustion engine is in an operating mode that does not require an injection of fuel, opening a selected injector over a control period for injecting a minimum amount, wherein at least one working cycle with injector control follows or precedes at least one working cycle without injector control, b) determining a differential of two subsequent segment times of the internal combustion engine or another variable, which reproduces a temporal modification of a crankshaft angular velocity, as a measurement value for the working cycle with control and for the working cycle without control, respectively and c) forming a relation between the measurement values of the working cycles with and without control and using the relation to correct the injection characteristic curve, wherein the internal combustion engine operates with active ignition, the measurement value for the at least one working cycle with control being examined in order to take into account ignition faults and the aforementioned relation then only being used to correct the injection characteristic curve if the respective measurement value in the working cycle with injector control significantly deviates from the measurement value or the measurement values in the working cycle or in the working cycles without injector control.

2. The method according to claim 1, wherein the aforementioned measurement values are measured over a plurality of working cycles.

3. The method according to claim 1, wherein the injection characteristic curve is adapted successively for at least two or all injectors of the internal combustion engine.

4. The method according to claim 1, wherein the injection characteristic curve is adapted in each coasting phase or after a specific running time interval or a specific running distance interval during a coasting phase.

5. The method according to claim 1, wherein the aforementioned method steps are carried out for at least two different or a large number of control periods.

6. The method according to claim 1, wherein the aforementioned method steps are carried out for at least two different or a large number of control moments.

7. The method according to claim 1, wherein a characteristic map for controlling an injector is adapted during the correction process, the characteristic map setting the control period in relation to the injection amount or one of the variables determining the injection amount.

8. The method according to claim 1, wherein, in order to determine the significance of the deviation of the measurement value with injector control from the measurement value without control, the measurement values of a plurality of working cycles are recorded and a mean value for the measurement value in the working cycle without control is then formed, the significance being defined as a function of the standard deviation of the measurement values without control or of a threshold for the deviation from the aforementioned mean value.

9. The method according to claim 1, wherein a setting is determined by additionally varying at least one parameter of injection of the minimum amount, in which the number of ignition failures is minimized.

10. The method according to claim 1, wherein the control period of the injector or injectors is adapted in such a way that a desired value of the deviation of the measurement values with injector control from the measurement value without control is obtained for injection of the minimum amount and this change is taken into account during operation of the internal combustion engine, even for larger injection amounts.

11. The method according to claim 1, wherein a characteristic map for controlling an injector is adapted during the correction process, the characteristic map setting the control period in relation to the injection amount or one of the variables determining the injection amount as a function of at least one of temperature, fuel pressure, and other parameters.

12. A device for adapting an injection characteristic curve, comprising a processor configured to control an injection behaviour of an internal combustion engine such that when the internal combustion engine is in an operating mode that does not require an injection of fuel, a selected injector is opened over a control period for injecting a minimum amount, wherein at least one working cycle with injector control follows or precedes at least one working cycle without injector control, a differential of two subsequent segment times of the internal combustion engine or another variable, which reproduces a temporal modification of a crankshaft angular velocity, is determined as a measurement value for the working cycle with control and for the working cycle without control, respectively and a relation is formed between the measurement values of the working cycles with and without control and used to correct the injection characteristic curve, wherein the internal combustion engine operates with active ignition, the measurement value for the at least one working cycle with control being examined in order to take into account ignition faults and the aforementioned relation then only being used to correct the injection characteristic curve if the respective measurement value in the working cycle with injector control significantly deviates from the measurement value or the measurement values in the working cycle or in the working cycles without injector control.

13. The device according to claim 12, wherein the device comprises an engine control system of the internal combustion engine.

14. The device according to claim 12, wherein the device comprises at least one sensor for acquiring at least one of a segment time of a crankshaft movement of the internal combustion engine and a current crankshaft angular velocity.

15. The device according to claim 12, wherein the aforementioned measurement values are measured over a plurality of working cycles.

16. The device according to claim 12, wherein the injection characteristic curve is adapted successively for at least two or all injectors of the internal combustion engine.

17. The device according to claim 12, wherein the injection characteristic curve is adapted in each coasting phase or after a specific running time interval or a specific running distance interval during a coasting phase.

18. The device according to claim 12, wherein a characteristic map for controlling an injector is adapted during the correction process, the characteristic map setting the control period in relation to the injection amount or one of the variables determining the injection amount.

19. The device according to claim 12, wherein in order to determine the significance of the deviation of the measurement value with injector control from the measurement value without control, the measurement values of a plurality of working cycles are recorded and a mean value for the measurement value in the working cycle without control is then formed, the significance being defined as a function of the standard deviation of the measurement values without control or of a threshold for the deviation from the aforementioned mean value.

20. The device according to claim 12, wherein a setting is determined by additionally varying at least one parameter of injection of the minimum amount, in which the number of ignition failures is minimized.

* * * * *